US005335511A

United States Patent [19]

McKeown

[11] Patent Number: 5,335,511

[45] Date of Patent: Aug. 9, 1994

[54] REFRIGERANT RELEASE PREVENTION SYSTEM

[76] Inventor: Dennis McKeown, 114 Summer La., Biloxi, Miss. 39532

[21] Appl. No.: 118,872

[22] Filed: Sep. 9, 1993

Related U.S. Application Data

[63] Continuation-in-part of Ser. No. 2,176, Jan. 8, 1993, Pat. No. 5,259,204.

[51] Int. Cl.[5] ..... F25B 41/00

[52] U.S. Cl. ..... 62/174; 62/149; 62/DIG. 17

[58] Field of Search ..... 62/77, 149, 174, 292, 62/DIG. 17

[56] References Cited

U.S. PATENT DOCUMENTS

| | | | |
|---|---|---|---|
| 2,065,429 | 12/1936 | Clapp . | |
| 2,157,579 | 5/1939 | Urquhart . | |
| 2,583,062 | 1/1952 | Riboud . | |
| 2,682,154 | 6/1954 | Wilkinson . | |
| 2,682,752 | 7/1954 | Branson . | |
| 2,899,013 | 8/1959 | Carter . | |
| 3,232,070 | 2/1966 | Sparano . | |
| 3,237,422 | 4/1966 | Pugh | 62/174 |
| 3,276,620 | 10/1966 | Dorfman . | |
| 3,353,367 | 11/1967 | Garland . | |
| 3,602,002 | 8/1971 | Bailey et al. . | |
| 3,672,180 | 6/1972 | Davis . | |
| 3,736,763 | 6/1973 | Garland . | |
| 3,844,264 | 10/1974 | Grainger . | |
| 3,848,425 | 11/1974 | Watkins . | |
| 4,185,469 | 1/1980 | Rogers et al. . | |
| 4,246,938 | 1/1981 | Morgan . | |
| 4,332,136 | 6/1982 | Quack . | |
| 4,350,018 | 9/1982 | Frank et al. . | |
| 4,606,195 | 8/1986 | Winkler . | |
| 4,918,927 | 4/1990 | Eigenbrod . | |
| 4,922,973 | 5/1990 | Keneavy . | |
| 4,953,357 | 9/1990 | Van Steenborgh . | |
| 5,050,393 | 9/1991 | Bryant . | |
| 5,140,827 | 8/1992 | Reedy . | |

*Primary Examiner*—John M. Sollecito
*Attorney, Agent, or Firm*—Alexander F. Norcross

[57] ABSTRACT

A system for diverting refrigerant into an auxiliary receiving vessel to reduce refrigerator system pressure during an incipient over-pressure condition to prevent activation of safety pressure relief valves and release of refrigerant into the atmosphere.

4 Claims, 2 Drawing Sheets

REFRIGERANT RELEASE PREVENTION SYSTEM

RELATED APPLICATIONS

This application is a continuation in part of my copending application Ser. No. 08/002,176, filed Jan. 8, 1993, now U.S. Pat. No. 5,259,204.

BACKGROUND OF THE INVENTION

This invention relates to the field of mechanical refrigeration units using halogen containing compounds, especially Freon and its derivatives. Freon and its related compounds are known and widely used as heat transfer media in mechanical refrigeration apparatus, including units intended for unattended operation such as truck and trailer mounted units. Such units usually include a refrigerant receiving tank, a pressure vessel for storage of liquid refrigerant, which also may include means for assisting in the condensation of gaseous refrigerant to a liquid state; an evaporator converting the refrigerant into a cold gas, which provides the cooling effect; a condenser for converting the hot gaseous refrigerant into a cooler liquid form, and a compressor which establishes a refrigerant pressure differential around the system, causing refrigerant flow. Since the units include pressurized storage of an evaporative liquid, safety codes require that each system have pressure relief valves, which release refrigerant if internal system pressure rises above a certain level.

More recently, it has become known that release of chlorinated hydrocarbons into the atmosphere is a significant environmental danger. Since typical trailer borne refrigeration systems contain approximately 13 pounds (liquid) of such refrigerants, pressure relief can result in a significant release of such refrigerant.

No system is known to the applicant for capture or prevention of release of refrigerants when an over-pressure situation occurs or a pressure relief valve opens. U.S. Pat. No. 2,682,752 to Branson shows, in the field of petroleum storage, a system in which pressure reacting switches divert vapor from a system to an overflow tank. U.S. Pat. No. 3,736,763 discloses the use of pressure responsive switches to control the flow of fluids in a refrigeration system.

SUMMARY OF THE INVENTION

This invention is of a system for diverting refrigeration into an auxiliary receiving vessel to reduce system pressure during an incipient over-pressure condition to prevent activation of safety pressure relief valves and release of refrigerant into the atmosphere.

The system is added to a typical mechanical refrigeration unit, of the type intended for extensive unattended use. A typical example is a trailer or shipping container mounted refrigeration unit of the type used for shipment of food or perishable commodities. Such units operate continuously, without monitoring or surveillance. In ship movement of containers, it will be found after each voyage that one or more containers has vented a significant amount of refrigerant overboard due to overpressure. This poses an environmental threat, as well as risking damage to the refrigeration system and container contents due to continued operation of the machinery without adequate refrigerant.

It is found that such mechanical refrigeration units can be classified into two general types, depending on the location of the pressure relief valves. The first type locates the pressure relief valves in the liquid side of the refrigeration cycle; dumping of liquid refrigerant is the most effective method of reducing system pressure. In this type the valve may be installed as an over-pressure dump in a liquid line, which theoretically only dumps sufficient refrigerant to lower pressure. Alternately, the valve is a "soft plug", usually installed in the primary pressure vessel, which blows out, dumping all system refrigerant.

The second type provides the pressure relief in the hot gas side of the refrigeration system. While this is usually the highest pressure side of the system, gas release does not usually immediately reduce the over-pressure condition, especially as the usual design of a refrigeration system results in increased flow of refrigerant to the hot gas side as the pressure drops. Therefore a larger quantity of refrigerant must be vented to reduce pressure in this type of system.

The invention adds to the existing system a parallel, secondary receiver tank, connected by a receiving line to a pressure activated dump valve in the line in which the system primary safety valve is located, and connected through a supply line to a pressure activated valve in a low pressure side of the system, usually at the inlet side of the compressor.

The pressure activated dump valve is set to open at a pressure less that the set point of the system's original pressure relief valves, but above any normal system working pressure. Depending on the class of the system, this valve may divert either liquid or gaseous refrigerant into the auxiliary receiving tank. The volume of this tank is such that a significant percentage of the system refrigerant charge can be accepted under such over-pressure conditions; this volume reduction in system refrigerant charge is sufficient to lower system pressure and prevent venting by the system safety pressure reliefs in almost all cases, including all localized temporary over-pressure conditions.

The reduction in refrigerant charge will result in a lowering of system pressure. When the condition which produced the over pressure ceases, this loss of refrigerant charge will result in a drop of pressure at the compressor inlet to a below normal pressure. A pressure sensor monitors refrigerant pressure in the auxiliary receiving tank as a measure of whether refrigerant has been diverted to the auxiliary tank. This sensor generates a signal when the auxiliary tank is pressurized. The control means also senses the pressure in the high pressure side of the system. When this high pressure drops below a point at which it is safe to add refrigerant to the system, a signal is generated. In response to this signal, the supply line pressure activated valve opens, returning the diverted refrigerant to the system. The difference in pressure resulting from the fact that the fact that refrigerant is always removed from a high pressure point in the system and always returned to a low pressure point, results in a pressure profile across the auxiliary tank which insures that adequate removal capability is available to relieve over-pressure, but the system will not be starved of refrigerant after the cause of the over-pressure is alleviated or under any normal operating condition, as scavenged refrigerant will always flow to the return line to the system.

It is thus an object of the invention to prevent release of refrigerant to the atmosphere in most over-pressure conditions.

It is a further object of the invention to relieve temporary over-pressure conditions in mechanical refrigeration units without venting refrigerant into the atmosphere.

It is a further object of the invention to conserve refrigerant, restoring refrigerant charge levels to systems after alleviation of temporary over-pressure conditions.

These and other objects of the invention may be seen from the detained description of the preferred embodiments given below.

DETAILED DESCRIPTION OF THE INVENTION

Figure 1:
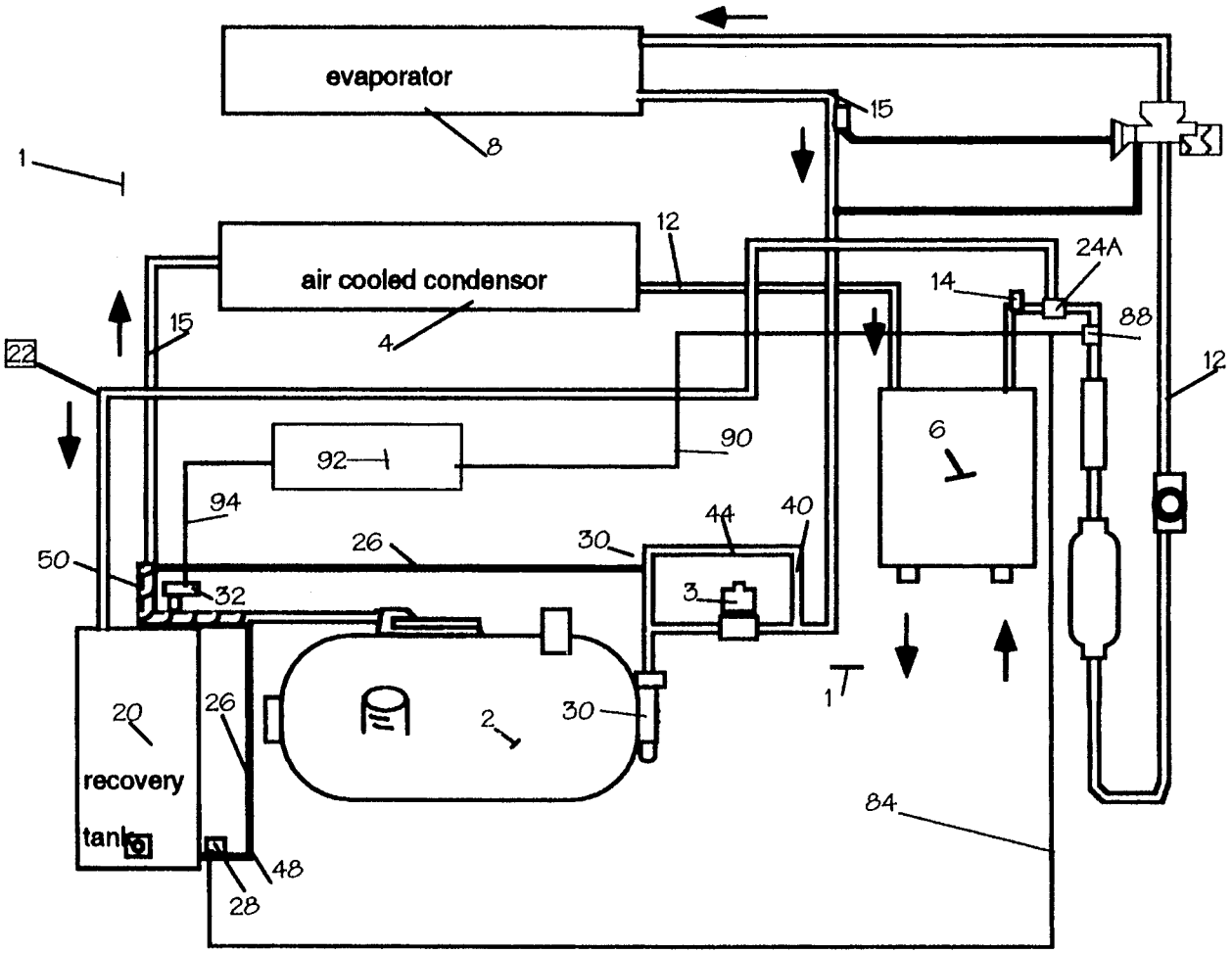
FIG. 1 is a schematic view of a typical installation of the invention.
Figure 2:
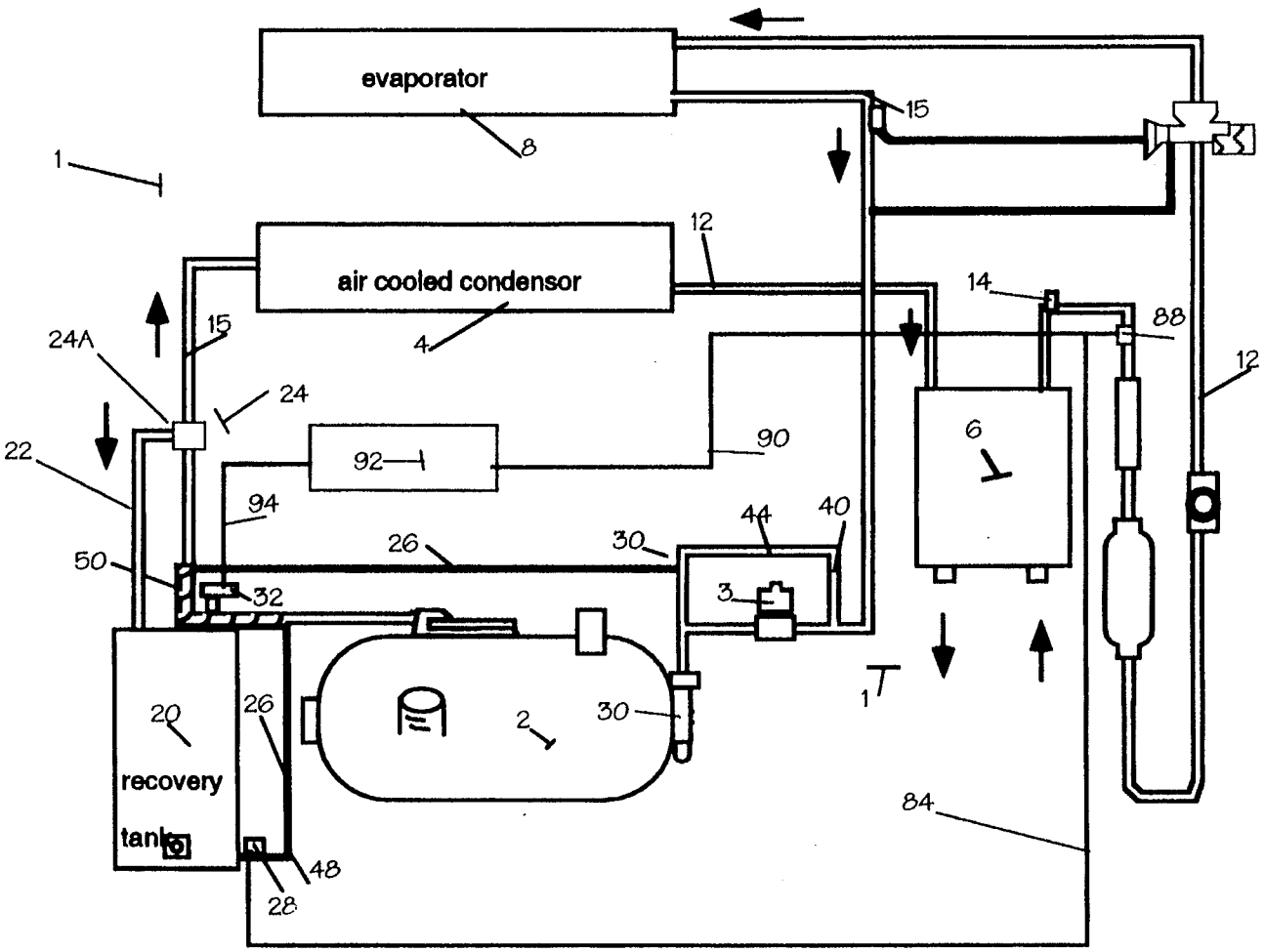
FIG. 2 is a schematic showing an alternate form of the invention.

The invention is shown as a recovery system installed on a standard closed cycle refrigeration system 1. A gaseous refrigerant is compressed by a compressor 2 and then cooled in a condenser 4 to a liquid state. The liquid fills the liquid side piping 12 and may be held in a storage reservoir 6; it flows under system pressure created by the compressor 2, as required for cooling, to an evaporator 8. Evaporation of the refrigerant produces the cooling effect, but results in the return of the refrigerant to a gaseous state. Since the refrigerant flows through the system 1 as a result of a pressure differential created by the compressor 2, it is customary to use a modulator valve 3 to control return flow of refrigerant to the compressor. As the modulator valve 3 cuts off refrigerant flow, the cooling rate of the system 1 is reduced; the modulator valve thus is normally controlled by a system thermostat (not shown) located in the cooled spaces to control the amount of system cooling.

Two points of high pressure danger exist within such a system. First, at any time the bulk of the refrigerant is in liquid form within the system 1 or reservoir 6. If, for any reason, the system 1 is exposed to excessive temperatures, then evaporation of this liquid will cause an increase in pressure; the greatest danger of over pressure failure is to the liquid reservoir 6, and thus the reservoir 6 or its liquid side piping 12 will be equipped with pressure relief devices 14, either as a pressure relief valve 14, or as a blow out plug. The principal difference between these devices is that the relief valve should close and cease venting once the over pressure condition is relieved; a "soft plug" or blow plug simply dumps the entire refrigerant supply to the atmosphere. It happens however, since in normal use a pressure relief valve 14 never is cycled, that often the pressure relief valve will not properly seat, due to contamination, age or debris, and thus all the refrigerant will escape once the valve activates.

In the invention an auxiliary receiver tank 20 is provided with a volume approximately one-third of the volume of the main system 1. A recovery supply pipe 22 connects this tank to a means 24 for diverting flow of refrigerant from the system 1 during over pressure conditions.

In one embodiment, this means 24 is a supply pipe 22 end installed over, in sealed fluid communication with the outlet of the pressure relief valve 14. As a result, refrigerant vented by the pressure relief valve 14 flows directly into the recovery supply pipe 22 and into the auxiliary receiver tank 20.

It is possible that safety codes would prohibit covering the relief valve 14 in this manner, or the system 1 may be one in which the outlet of the pressure relief is not suitable for connection of a pipe. Such systems would include those in which a blow out plug is installed in the reservoir body 6. In this case a separate secondary diverter valve 24A is installed in the same piping section or tank as the main relief valve 14 or blow out plug. The outlet of this secondary valve 24A is connected by sealed connection to the recovery supply pipe. This secondary relief valve 24A will be set to open at a pressure below the set point of the main relief valve 14, but well above standard system working pressure. Since typically pressure relief valves are set for a pressure of over twice normal working pressure, such a setting is easily determined for any typical refrigeration system.

The recovery supply pipe 22 connects directly to the auxiliary receiver tank 20, and any fluid or gas vented into the recovery supply pipe 22 will flow into the auxiliary receiver tank 20. Since flow to the auxiliary receiver tank 20 will only occur during over pressure conditions, the refrigerant pressure during filing of the auxiliary tank 20 will be well above normal system working pressure, and the tank 20, although of relatively small volume, will therefore receive and hold a significant fraction of the refrigerant from the system 1 as overflow.

The removal of this overflow refrigerant will lower pressure in the main system 1. As soon as the system pressure drops below the set point of the pressure relief valve 14 or the secondary diverter valve 24A, that valve will close, maintaining refrigerant pressure in the auxiliary tank 20 at a higher pressure than system working pressure.

A recovery return pipe 26 connects the auxiliary tank 20 to a pressure recovery valve 28 located for feed of recovered refrigerant to the suction side 30 of the system compressor 2. This connection to the suction side 30 is preferably through a solenoid valve 28, controlled by an electrical control current controlled by a system recovery pressure switch 32. This switch 32 is connected to detect refrigerant pressure in the auxiliary tank 20, as an indication that refrigerant has been diverted due to over pressure.

A signal, corresponding to the detection of refrigerant pressure in auxiliary tank 20 is communicated by signal line 94 to control means 92. Control means 92 is an electrical control, either using discrete logic, either relay control or electronic logic circuits, or a microprocessor control implementing such control logic. Control means 92 responds to the presence of signal on signal line 94 indicating refrigerant pressure in the auxiliary tank 20, and to signal on signal line 90 indicating an over-pressure condition as sensed by a high pressure side pressure sensor 88 as follows.

The high pressure side sensor 88 is located in the pressure side line 12 near the high pressure relief valve 14 and system overflow relief 24A. This sensor 88 signals an electrical signal corresponding to the high side 12 system pressure to the control means 92. For every refrigeration system there is a pressure on the high side which corresponds to the highest pressure at which it is suitable to add refrigerant to the system without incurring an over-pressure situation. This highest pressure varies with whether refrigerant is added as a gas or a liquid, but is predetermined for all systems. based on system design. The control means logic is set so that this highest pressure is a recovery set point.

The condition causing the over-pressure is almost always temporary. Therefore, the control logic senses first the existence of a n overflow recovery by sensing through recovery tank pressure sensor 32 the presence of refrigerant in the recovery tank 20. The control logic then continuously monitors the signal from the high pressure sensor 88, which will be initially above the set point. With time, the condition causing system over-pressure ameliorates, and the high side 12 pressure drops as the compressor 2 recovers gaseous refrigerant, and as the condenser 4 condenses the remaining refrigerant into a liquid. When the high side 12 pressure drops below the set point, the pressure sensor 88 signal corresponding to a high pressure below the set point is sensed by the control means 92, and the control means generates a signal through control line 84 to recovery line valve 28 which opens the valve, connecting the refrigerant in the recovery tank to the suction side 30 of the compressor 2, scavenging the recovered refrigerant back into the refrigeration system. If the total quantity of recovered refrigerant is too great, the high pressure side pressure will rise above the set point, which is sensed by sensor 88, and by control means 92 through signal line 90. Control means 92 then generates a control signal through control line 84, closing recovery valve 28. The process continues until all recovered refrigerant is returned to the system.

The control means 92 will recover the refrigerant from overflow, thus preventing loss of refrigeration by too severe a drop in high side 12 system pressure; yet, the control means 92 prevents the too early or too fast return of captured refrigerant to the system, which would cause system over-pressure to recur.

The recovery precess continues until a sensed drop in pressure in the recovery tank which corresponds to the point where all recoverable refrigerant has been returned to the system. This is usually where the recovery tank 20 pressure equals the suction side pressure at the compressor suction inlet 30, the lowest system pressure. Upon a signal corresponding to this low pressure, the control means 92 logic will through control signal line 84 close the recovery solenoid 28, the diverted refrigerant having been returned to the system, restoring normal operation.

Under normal conditions, the suction side 30 of the compressor 2 will draw down the pressure in the auxiliary receiver tank 20 to the lowest system pressure, recovering substantially all the dumped refrigerant. In any event, all refrigerant is contained within the system 1 or within the recovery system, and no refrigerant is dumped to the atmosphere.

All refrigerator compressors 2 are designed to compress a gaseous refrigerant; all compressors 2 also depend on a continuous flow of refrigerant for lubrication and cooling. Some compressors 2 are sufficiently strong that they can function in the presence of a small percentage of liquid refrigerant, but most systems have valves or expansion orifices in the return piping 40 to prevent liquid being applied to the suction side. Most systems control cooling by a modulator valve 3, which cuts off refrigerant flow to cut off cooling. Since full cutoff of all refrigerant also cuts off all cooling and lubrication to the compressor 2, most systems have a small diameter secondary refrigeration piping and valve 44, sometimes called a quench valve which bypasses a small quantity of refrigerant, and expands it to a gas, to support the compressor 2 whenever the modulator valve 3 cuts off main refrigerant flow.

Depending on the design of the system 1 to which the recovery system of the invention is connected, the pressure relief valve 24 may be in a liquid side 12 of the system or a gas side 15 of the system. If the system is such that the overflow refrigerant is liquid, then it is preferred that the recovery return pipe 26 be connected so as to provide a gaseous refrigerant to the compressor 2. This can be done by passing the recovered refrigerant through a heat exchanger 50 interconnected with the hot gas side 15 line coming from the compressor 2, so as to vaporize the return recovery refrigerant before return to the compressor. Alternately, the return pipe 26 can be a small diameter pipe, for example one-quarter inch diameter, including an expansion orifice 48 in return pipe 26.

It can be seen that the system as described is adaptable to many variant refrigeration systems, and in each case, prevents temporary or localized over pressure conditions from dumping refrigerant to the atmosphere, but rather removes refrigerant from the system lowering system pressure to a safe level, and then, when the cause of the over pressure is removed, and system pressure drops, returns the recovered refrigerant to assure continued safe system operation. The invention adds little bulk to the existing system, and requires no sophisticated control system which might fail for its continued operation. The invention is thus especially suitable for shipping container and truck trailer refrigeration systems which must run for extended periods of time as unattended systems.

The disclosed invention is also applicable to motor vehicle installed air conditioners, including automobiles and trucks.

I claim:

1. An apparatus for preventing the release of refrigerant from a mechanical refrigeration system having piping within which is placed a system safety pressure relief value having a relief set point, and having a compressor having a suction side, comprising:

an auxiliary receiving tank;

a refrigerant flow line in fluid connection to said tank from a pressure relief valve in the system line having a system relief valve, which conducts flow of refrigerant to said tank upon opening of said pressure relief valve;

a refrigerant flow return line in fluid connection from said tank to a second valve located in a low pressure point in the mechanical refrigeration system; and control means for opening said second valve responsive to refrigerant pressure in said auxiliary tank and a drop in the pressure of refrigerant adjacent the system relief valve to below a set point.

2. The apparatus of claim 1, said set point being that system pressure below which it is safe to add refrigerant charge to the system without creating an overpressure condition.

3. The apparatus of claim 1, said control means comprising:

a high pressure sensor for sensing system pressure in the line adjacent the system pressure relief valve;

a recovery tank pressure sensor for sensing refrigerant pressure in the auxiliary receiving tank;

control logic responsive to said high pressure sensor and said recovery tank sensor for opening or closing said second valve, controlling flow of refrigerant from the auxiliary receiving tank to said low pressure point.

4. The apparatus of claim 1, said low pressure point comprising the suction line of the compressor.

* * * * *